US006818079B2

(12) United States Patent
Inoue et al.

(10) Patent No.: US 6,818,079 B2
(45) Date of Patent: Nov. 16, 2004

(54) METHOD FOR MANUFACTURING A STEEL SHEET

(75) Inventors: Tadashi Inoue, Fukuyama (JP); Yoichi Motoyashiki, Fukuyama (JP); Hiroyasu Kikuchi, Fukuyama (JP); Yoshimasa Funakawa, Yokohama (JP); Hiroshi Nakata, Fukuyama (JP); Sadanori Imada, Fukuyama (JP); Toru Inazumi, Ann Arbor, MI (US)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 10/445,631

(22) Filed: May 27, 2003

(65) Prior Publication Data

US 2003/0205302 A1 Nov. 6, 2003

Related U.S. Application Data

(62) Division of application No. 09/838,017, filed on Apr. 19, 2001, now Pat. No. 6,623,573, which is a continuation of application No. PCT/JP00/06640, filed on Sep. 27, 2000.

(30) Foreign Application Priority Data

| | | |
|---|---|---|
| Sep. 19, 1999 | (JP) | 11-275956 |
| Jan. 14, 2000 | (JP) | 2000-006633 |
| Jun. 20, 2000 | (JP) | 2000-173934 |
| Jun. 21, 2000 | (JP) | 2000-186535 |
| Sep. 5, 2000 | (JP) | 2000-268896 |

(51) Int. Cl.[7] ..... C21D 8/00; C21D 8/02

(52) U.S. Cl. ..... 148/602; 148/661; 148/654; 148/541; 148/547

(58) Field of Search ..... 148/320, 654, 148/661, 602, 547, 541, 664

(56) References Cited

U.S. PATENT DOCUMENTS

| | | | |
|---|---|---|---|
| 6,554,925 | B2 | 4/2003 | Inoue et al. |
| 6,632,295 | B2 | 10/2003 | Nakata et al. |
| 6,652,670 | B2 | 11/2003 | Inoue et al. |
| 6,663,725 | B2 | 12/2003 | Inoue et al. |

FOREIGN PATENT DOCUMENTS

| | | | |
|---|---|---|---|
| EP | 0 719 868 | A1 | 7/1996 |
| JP | 54-65118 | A | 5/1979 |
| JP | 56-33429 | A | 4/1981 |
| JP | 60-121225 | A | 6/1985 |
| JP | 61-15929 | B2 | 4/1986 |
| JP | 63-67524 | B2 | 12/1988 |
| JP | 4-246127 | A | 9/1992 |
| JP | 4-337026 | A | 11/1992 |
| JP | 4-341523 | A | 11/1992 |
| JP | 9-241742 | A | 9/1997 |
| JP | 11-193443 | A | 7/1999 |
| JP | 11-269556 | A | 10/1999 |
| JP | 11-343521 | A | 12/1999 |

*Primary Examiner*—Deborah Yee
(74) *Attorney, Agent, or Firm*—Frishauf, Holtz, Goodman & Chick, P.C.

(57) ABSTRACT

A method for manufacturing a steel sheet comprising continuously casting a steel containing 0.04 to 0.2 wt. % C, 0.25 to 2 wt. % Si, 0.5 to 2.5 wt. % Mn, and 0.1 wt. % or less Al to form a slab; hot-rolling by rough-rolling the slab to form a sheet bar and finish-rolling the sheet bar with a reduction in thickness at the final stand of less than 30%, the finish-rolling being completed at a temperature from the $Ar_3$ transformation point to the $Ar_3$ transformation point +60° C.; primary-cooling the hot-rolled steel sheet, the primary cooling being started within 1 second after the completion of hot-rolling and conducting the cooling at a cooling speed of higher than 200° C./sec down to a temperature of $Ar_3$ −30° C. to the $Ar_1$ transformation point; slow cooling or air-cooling the primary-cooled steel sheet at a temperature of the $Ar_3$ transformation point to the $Ar_1$ transformation point at 10° C./sec or less for 2 seconds or more; secondary-cooling the steel sheet after the slow cooling or the air-cooling at 30° C./sec or more; and coiling the secondary-cooled steel sheet at 300° C. or less.

8 Claims, 3 Drawing Sheets

METHOD FOR MANUFACTURING A STEEL SHEET

This application is a divisional application of Ser. No. 09/838,017, filed Apr. 19, 2001 (U.S. Pat. No. 6,623,573) which is a continuation application of International application PCT/JP00/06640 (not published in English) filed Sep. 27, 2000.

FIELD OF THE INVENTION

The present invention relates to a steel sheet such as hot-rolled steel sheet and cold-rolled steel sheet, and to a method for manufacturing the same.

BACKGROUND OF THE INVENTION

Steel sheets such as hot-rolled steel sheets and cold-rolled steel sheets are used in wide fields including automobiles, household electric appliances, and industrial machines. Since these steel sheets are subjected to some processing before use, they are requested to have various kinds of workability. For example, high strength hot-rolled steel sheets which are not subjected to deep drawing of 340 MPa or more strength are requested to have high stretch flanging performance during burring.

Recently, the request of users of steel sheets regarding the quality becomes severer than ever. The request includes not only further improvement in the workability but also the homogeneity in mechanical properties in, a coiled product.

Responding to the requirements of the users, there are several proposals. For example, JP-B-61-15929 and JP-B-63-67524, (the term "JP-B" referred herein signifies the "Examined Japanese Patent Publication"), disclose a method to improve the workability of high strength hot-rolled steel sheet by controlling the cooling speed after hot-rolled and by controlling the coiling temperature, and JP-A-9-241742, (the term:JP-A" referred herein signifies the "Unexamined Japanese Patent Publication"), discloses a method to improve the homogeneity of mechanical properties in a hot-rolled coil by continuation of the hot-rolling process.

The high strength hot-rolled steel sheets manufactured by the method disclosed in JP-B-61-15929 and JP-B-63-67524, however, failed to attain sufficiently superior stretch flanging performance. Also when the method disclosed in JP-A-9-241742 is applied to high strength steel sheet, homogeneous excellent mechanical properties cannot be attained.

Since the high strength hot-rolled steel sheets having texture consisting essentially of ferrite and martensite have superior balance of elongation and strength and give excellent workability, they are increasing in applications to various structural members and parts aiming at weight reduction of automobiles. Along with the ever-widening their application field, the use conditions have increased in their severity, so that further improvement in their workability is wanted. To increase the balance of elongation and strength of that kind of textured steels, further fine texture is required.

That type of textured steel is manufactured by cooling (primary cooling) from the state of $Ar_3$ transformation point or above to the region of ferrite-austenite two phase temperatures, and by holding the temperature region for a specified time to enhance the ferrite transformation to enrich C to the austenite phase, then by rapid cooling (secondary cooling) to transform the austenite to martensite. Technologies to establish fine texture by specifying the manufacturing conditions are proposed. For example, JP-A-54-65118 discloses the technology to suppress the grain growth by regulating the primary cooling speed to 80° C./sec or more. JP-A-56-33429 discloses the technology to obtain fine ferrite by applying the temperatures to start the primary cooling of from 720 to 850% and by applying the primary cooling speeds of from 30 to 200° C./sec. JP-A-60-121225 discloses the technology to obtain finely dispersed ferrite and to obtain fine martensite by applying cumulative drafts of 45% or more between the $Ar_3$ transformation point and the ($Ar_3$ transformation point +40° C.).

However, all of JP-A-54-65118, JP-A-56-33429, and JP-A-60-121225 have limitation to establish fine texture because the technological investigation was conducted in a limited range of primary cooling speeds of 200° C./sec or less assuming the application of cooling capacity of existing commercial facilities or experimental apparatuses.

DISCLOSURE OF THE INVENTION

It is an object of the present invention to provide a method for manufacturing steel sheets which have excellent workability including the stretch flanging performance and which have various strength levels with homogeneous mechanical properties.

To attain the object, the present invention provides a method for manufacturing steel sheet comprising the steps of: forming a sheet bar; forming a steel strip; primary-cooling; air-cooling; secondary-cooling; and coiling.

The step of forming the sheet bar comprises rough-rolling a continuously cast slab consisting containing 0.8% or less C by weight.

The step of forming the steel strip comprises finish-rolling the sheet bar at finish temperatures of ($Ar_3$ transformation point −20° C.) or more.

The step of primary-cooling comprises cooling the finish-rolled steel strip at cooling speeds of higher than 120° C./sec down to temperatures of from 500 to 800° C.

The step of air-cooling comprises air-cooling the primary-cooled steel strip during a period of from 1 to 30 seconds.

The step of secondary-cooling comprises cooling the steel strip at cooling speeds of 20° C./sec or more after air-cooling.

The step of coiling comprises coiling the secondary-cooled steel strip at temperatures of 650° C. or less.

For the case of continuously cast slab containing more than 0.8% C by weight, the step of forming the steel strip comprises finish-rolling at finishing temperatures of (Arcm transformation point −20° C.) or more.

It is another object of the present invention to provide a method for manufacturing high strength steel sheet having excellent sheet shape and workability, which steel sheet has superior balance of elongation and strength by establishing fine structure without damaging the sheet shape.

To attain the object, the present invention provides a method for manufacturing steel sheet comprising the steps of: forming a slab; hot-rolling; primary-cooling; applying slow cooling or air-cooling; and coiling.

The step of forming the slab comprises the continuous casting of a steel consisting essentially of 0.04 to 0.2% C, 0.25 to 2% Si, 0.5 to 2.5% Mn, and 0.1% or less sol.Al, by weight.

The step of hot-rolling comprises rough-rolling the slab to prepare sheet bar, and finish-rolling the sheet bar. The finish-rolling is conducted by giving the reduction in thickness at the final stand of less than 30%, and is completed in a temperature range of from $Ar_3$ transformation point to ($Ar_3$ transformation point +60° C.).

The step of primary cooling starts the cooling within 1.0 second after the completion of the hot-rolling, and the cooling speed is higher than 200° C./sec down to the temperatures of from ($Ar_3$ transformation point −30° C.) to $Ar_1$ transformation point.

The step of slow cooling or air-cooling is carried out at cooling speeds of 10° C./sec or less for 2 seconds or more in the temperature range of from $Ar_3$ transformation point to $Ar_1$ transformation point.

The step of coiling is done after the secondary cooling at temperatures of 300° C. or less.

It is another object of the present invention to provide a method for manufacturing high strength steel sheet having excellent workability such as local elongation.

To attain the object, the present invention provides a method for manufacturing steel sheet comprising the steps of: forming a sheet bar; finish-rolling; primary-cooling; applying slow cooling; secondary-cooling; and coiling.

The step of forming the sheet bar comprises rough-rolling a steel consisting essentially of 0.04 to 0.2% C, 0.25 to 2% Si, 0.5 to 2.5% Mn, and 0.1% or less Al, by weight.

The step of finish-rolling comprises finish-rolling the sheet bar at rolling temperatures of 1,050° C. or less, cumulative reductions in thickness of 30% or more, and end temperatures of rolling of from $Ar_3$ transformation point to ($Ar_3$ transformation point +60° C.).

The step of primary cooling comprises cooling within 1.0 second after completed the finish-rolling at cooling speeds of higher than 200° C./sec through a cooling range where the difference between the temperature to start cooling and the end temperature of the cooling is in a range of from 100° C. to less than 250° C.

The step of slow cooling comprises cooling of the primary-cooled steel sheet at cooling speeds of 10° C./sec or less for a period of from 2 seconds to less than 20 seconds in a temperature range of from above 580° C. to 720° C.

The step of secondary cooling comprises cooling of the slowly cooled steel at cooling speeds of 30° C./sec or more.

The step of coiling comprises coiling of the secondary-cooled steel sheet at temperatures of below 400° C.

Furthermore, the present invention provides a method for manufacturing steel sheet comprising the steps of: forming a sheet bar; finish-rolling; primary-cooling; applying slow cooling; and coiling.

The step of forming sheet bar comprises rough-rolling a steel consisting essentially of 0.04 to 0.12% C, 0.25 to 2% Si, 0.5 to 2.5% Mn, 0.1% or less Al, by weight, and balance of substantially Fe and inevitable impurities.

The step of finish-rolling comprises finish-rolling the sheet bar at rolling end temperatures of $Ar_3$ transformation point or above.

The step of primary cooling comprises cooling of the finish-rolled steel sheet within 1.0 second after completed the finish-rolling at cooling speeds of more than 200° C./sec through a cooling range where the difference between the temperature to start cooling and the end temperature of the cooling is in a range of from 100° C. to less than 250° C.

The step of slow cooling comprises cooling the primary-cooled steel at cooling speeds of 10° C./sec or less for a period of from 2 seconds to less than 20 seconds in a temperature range of from above 580% to 720° C.

The step of coiling comprises coiling the slowly cooled steel sheet at temperatures of from 400° C. to below 540° C.

BEST MODE FOR CARRYING OUT THE INVENTION

Embodiment 1

Figure 1:
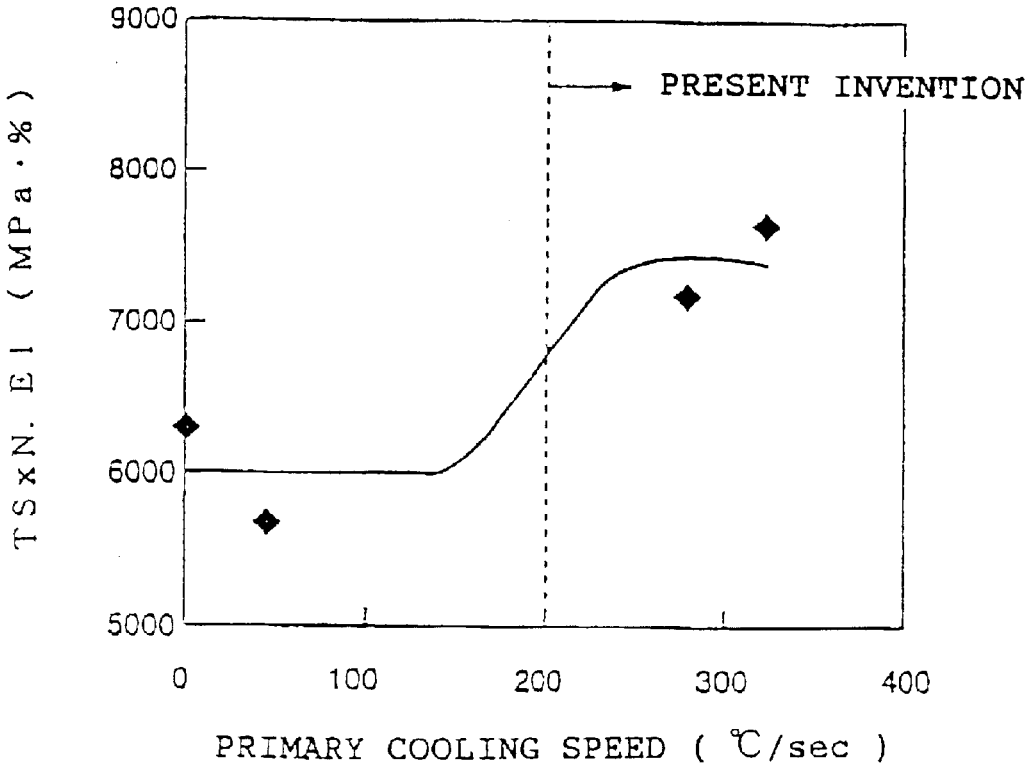
FIG. 1 is a graph showing the influence of the time to start cooling and the primary cooling speed on the TS×El value of steel sheet according to the Embodiment 2.

The method for manufacturing steel sheet according to the Embodiment 1 comprises the steps of: forming a sheet bar by rough-rolling a continuously cast slab containing 0.8% or less C by weight; forming a steel strip by finish-rolling the sheet bar at finishing temperatures of finish-rolling of not less than ($Ar_3$ transformation point −20° C.); primary-cooling the steel strip after the finish-rolling down to temperatures of from 500 to 800° C. at cooling speeds of higher than 120° C./sec; air-cooling the primary-cooled steel strip for a period of from 1 to 30 seconds; secondary-cooling the steel strip allowed to stand for cooling at cooling speeds of 20° C./sec or more; and coiling the steel strip after the secondary cooling at coiling temperatures of 650° C. or less.

When the continuously cast slab containing 0.8% or less C by weight and when the sheet bar is finish-rolled at finish-rolling temperatures of ($Ar_3$ transformation point −20° C.) or above, the grain size immediately after the finish-rolling can be reduced, which give fine grains in succeeding stages. As a result, the succeeding stages give fine grains, and the workability is improved, including the improvement in balance of strength and elongation and in stretch flanging performance.

When, after the rolling, the steel strip is primary-cooled at cooling speeds of more than 120° C./sec down to the temperature range of from 500 to 800° C., the ferritic grains and the precipitates such as pearlite after the transformation can be reduced in their size, thus improving the workability.

When, after the primary-cooling, the steel strip is air-cooled for a period of from 1 to 30 seconds, and when the steel is then secondary-cooled at cooling speeds of 20° C./sec or more, the structure of a coil after coiled can be homogenized, so the homogeneity of mechanical properties in a coil can be attained.

When, after the secondary-cooling, the steel strip is coiled at coiling temperatures of 650° C. or less, adequate low temperature transformation phase responding to respective compositions of the high strength steel sheets can be attained.

If the C content exceeds 0.8% by weight, a steel sheet having excellent workability and homogeneous mechanical properties can be obtained by finish-rolling at finish temperatures of (Acm transformation point −20° C.) or more while keeping other conditions to the same with those in the case of 0.8% or less C by weight.

When the continuously cast slab is heated to 1,230° C. or less followed by rough-rolling without cooling thereof to room temperature, the slab temperature before the rolling can be uniformized, and the mechanical properties in a coil can further be homogenized.

When the material being rolled is heated by an induction heating unit immediately before the finish-rolling or during the finish-rolling, the temperature of the material being rolled during the rolling can be uniformized, and the mechanical properties in a coil can further be homogenized.

When the primary cooling starts within a period of more than 0.1 second and less than 1.0 second after completed the finish-rolling, the ferritic grains and precipitates such as pearlite after the transformation can further be refined, and the workability can further be improved.

To reduce the dispersion of material quality of hot-rolled steel strip to more preferable level, it is necessary to regulate the above-described temperature to stop the rapid cooling into the range of the present invention and to regulate the variations of temperature (maximum value-minimum value) in the coil width direction and in the longitudinal direction thereof to 60° C. or less. The temperature in the coil width direction according to the present invention indicates the range excluding the 30 mm distance from each of the edges of the coil width taking into account also of the measurement method of temperature sensor.

As for the rapid cooling capacity, the variations of temperature after the above-described rapid cooling can be reduced by applying the cooling at heat transfer coefficients of 2,000 kcal/m$^2$ h° C. or more.

Thus, according to the present invention, the obtained steel sheet has the variations in tensile strength in the width direction of the steel sheet and in the longitudinal direction thereof within ±8% of the average of tensile strength in a coil by reducing the temperature variations in a coil. That type of steel sheet having narrow dispersion gives less variations of press-workability (such as spring back during bending working) and gives superior material performance.

According to the present invention, the composition of the steel is not specifically limited, and compositions of existing high strength hot-rolled steel sheets and of high strength cold-rolled steel sheets having various strength levels are applicable. That is, not only simple carbon steel sheets but also steel sheets containing special elements such as Ti, Nb, V, Mo, Zr, Ca, and B are applicable.

The steel sheet according to the present invention can be manufactured by ordinary steel making and hot-rolling process. The hot direct rolling process which directly hot-rolls the continuously cast slab without passing through heating furnace can also be applied. Furthermore, the continuous rolling process which uses a coil box and the like is also effectively applicable. Immediately before the finish-rolling or during the finish-rolling, when the material being rolled is heated by an induction heating unit, edge heating is also effective.

In the hot-rolling, when the finish-rolling is carried out so as the difference in the finish temperature in the material being rolled preferably to regulate within 50° C., the structure within the steel strip immediately after the finish-rolling can be homogenized. Thus, the homogeneity in the mechanical properties in the coiled steel strip can be established. From the point of establishing fine structure and of homogeneous structure, the upper limit of the C content is preferably regulated to ($Ar_3$ transformation point +50° C.) or less for the case of 0.8% or less C, by weight, and to (Acm transformation point +100° C.) or less for the case of 0.8% or less C, by weight.

In the primary cooling, to assure the dispersion in material quality to more preferable level, it is preferred to regulate the time to start the primary cooling to more than 0.5 second within the range of the present invention. As for the cooling speed, it is preferred to regulate to 200° C./sec or more, more preferably to 400° C./sec or more, from the point to attain finer structure. For reducing the variations in temperature in a coil, a preferable heat transfer coefficient is 5,000 kcal/m$^2$ h° C. or more, and more preferably 8,000 kcal/m$^2$h° C. or more.

Regarding the homogeneity of material quality, preferably the variations in tensile strength is maintained within ±4% to significantly improve the performance at users shops. In that case, the dispersion in the material quality can be narrowed to above-described range by regulating the variations of the temperature to stop the rapid cooling (primary cooling) within 40%. Furthermore, to obtain the variations in tensile strength within ±2%, the variations of temperature to stop the rapid cooling may be regulated to 20° C. or less. The reduction in the variations of material quality can be derived from the relation between the variations in these temperatures and the variations in the tensile strength.

To regulate the secondary cooling speed to 100° C./sec or more is further preferable to improve the workability through establishing fine structure.

When thus obtained hot-rolled coil is cold-rolled followed by annealing, the cold-rolled steel sheet that has excellent workability and homogeneous mechanical properties can be manufactured. In that case, the annealing is further preferred to be given by continuous annealing to establish homogeneous mechanical properties.

EXAMPLE 1

Steels Nos. 1 through 5 having the chemical compositions given in Table 1 were prepared by melting. The steels were rolled under the hot-rolling conditions given in Table 2 to form respective hot-rolled coils Nos. 1 through 11, each having a thickness of 3 mm. The heat transfer coefficients in the rapid cooling (primary cooling) in Example 1 were 3,000 to 4,000 kcal/m$^2$ h° C.

Tension testing specimens were prepared by cutting at 5 positions on each of the hot-rolled coil in the longitudinal direction thereof. On each specimen, average tensile strength (TS), total elongation (El), dispersion in tensile strength (ΔTS) were determined. For a part of the hot-rolled coils, hole expanding ratio (λ) and dispersion in hole expanding ratio (Δλ) were determined. The results are given in Table 3.

As clearly shown by comparing the Examples according to the present invention with the Comparative Examples, the Examples of the present invention give smaller values of ΔTS, ΔEl, and Δλ than those in the Comparative Examples, and give superior homogeneity of mechanical properties in a coil, further give higher El and λ values with superior workability in hot-rolled coil.

EXAMPLE 2

Steels Nos. 1 through 5 having the chemical compositions given in Table 1 were rolled under the hot-rolling conditions given in Table 4 to form respective hot-rolled coils Nos. 12 through 22, each having a thickness of 3 mm. The heat transfer coefficient in the primary cooling was 12,000 kcal/m$^2$ h° C. for the steels Nos. 12 through 17 of the Examples of the present invention, and 1,000 kcal/m$^2$ h° C. for the steels Nos. 18 through 22 of the Comparative Examples.

On each of these hot-rolled coils, the mechanical properties were determined similar to the Example 1. The result is shown in Table 5.

As clearly seen by comparing the steel sheets Nos. 12 through 17 of the Examples of the present invention with the steel sheets Nos. 18 through 22 of the Comparative Examples, having respective chemical compositions, the dispersions of mechanical properties, ΔTS and ΔEl, were smaller in the Examples of the present invention than those in the Comparative Examples, for all the chemical compositions tested. To the contrary, the steel sheets Nos. 18 through 22 of the Comparative Examples failed to satisfy one or more of the manufacturing conditions specified by the present invention, giving inferior homogeneity in the mechanical properties or inferior workability to the steel sheets Nos. 12 through 17 of the Examples of the present invention having the same chemical composition to the Comparative Example steels.

According to the Example 2, the variations of the temperature to stop the rapid cooling (primary cooling) within a coil are smaller than those in the conventional laminar cooling in the Comparative Examples, and the variations of mechanical properties are reduced to more preferable level. The cooling method according to the Example 2 is the perforated ejection type that has high heat transfer coefficient.

TABLE 1

| Steel | C | Si | Mn | S | P | 0 | N | Other |
|---|---|---|---|---|---|---|---|---|
| 1 | 0.850 | 0.24 | 0.47 | 0.003 | 0.017 | 0.0020 | 0.0025 | Zr: 0.005 |
| 2 | 0.071 | 0.03 | 1.23 | 0.001 | 0.012 | 0.0021 | 0.0040 | Ti: 0.082 |
| 3 | 0.092 | 0.83 | 1.57 | 0.001 | 0.012 | 0.0020 | 0.0035 | Ti: 0.020<br>Ca: 0.002 |
| 4 | 0.083 | 0.40 | 1.45 | 0.001 | 0.017 | 0.0018 | 0.0034 | B: 0.0025 |
| 5 | 0.222 | 1.62 | 1.53 | 0.001 | 0.010 | 0.0021 | 0.0014 | — |

TABLE 2

| Steel sheet No. | Steel No. | Slab heat-treatment history | Finish temperature (° C.) | Difference in finish temperature (° C.) | Time to start the primary cooling (sec) | Primary cooling speed (° C./sec) | End temperature of the primary cooling (° C.) | Time of air-cooling (sec) | Secondary cooling speed (° C./sec) | Coiling temperature (° C.) | Remark |
|---|---|---|---|---|---|---|---|---|---|---|---|
| 1 | 1 | Casting, then heating to 1,250° C. | (Arcm + 20)~(Arcm + 50) | 30 | 1.3 | 250 | 650 | 6 | 25 | 600 | E |
| 2 | 2 | Casting, then hot direct rolling | (Ar3 + 15)~(Ar3 + 45) | 30 | 0.4 | 225 | 700 | 7 | 200 | 605 | E |
| 3 | 2 | Casting, then hot direct rolling | (Ar3 + 15)~(Ar3 + 45) | 30 | 1.3 | 180 | 690 | 7 | 25 | 585 | E |
| 4 | 3 | Casting, then heating to 1,200° C. | (Ar3 + 30)~(Ar3 + 40) | 10 | 0.5 | 200 | 680 | 6 | 30 | 30 | E |
| 5 | 4 | Casting, then heating to 1,200° C. | (Ar3 + 5)~(Ar3 + 25) | 20 | 0.3 | 200 | 690 | 10 | 35 | 450 | E |
| 6 | 5 | Casting, then heating to 1,200° C. | Ar3~(Ar3 + 20) | 20 | 0.5 | 240 | 680 | 8 | 25 | 400 | E |
| 7 | 1 | Casting, then heating to 1,250° C. | (Arcm − 10)~(Arcm + 55) | 65 | 1.1 | 195 | 660 | 7 | 15 | 610 | C |
| 8 | 2 | Casting, then hot direct rolling | (Ar3 + 20)~(Ar3 + 40) | 20 | 0.7 | 210 | 710 | 8 | 15 | 605 | C |
| 9 | 3 | Casting, then heating to 1,200° C. | (Ar3 + 25)~(Ar3 + 50) | 25 | 0.5 | 185 | 680 | 6 | 25 | 30 | C |
| 10 | 4 | Casting, then heating to 1,200° C. | Ar3~(Ar3 + 25) | 25 | 0.3 | 190 | 690 | 6 | 60 | 450 | C |
| 11 | 5 | Casting, then heating to 1,200° C. | Ar3~(Ar3 + 15) | 15 | 0.3 | 75 | 705 | 10 | 50 | 410 | C |

E: Example
C: Comparative example

TABLE 3

| Steel sheet | | Mechanical properties of hot-rolled coil | | | | | | |
|---|---|---|---|---|---|---|---|---|
| No. | Steel No. | TS(MPa) | Δ TS(MPa) | El (%) | Δ El (%) | λ (%) | Δ λ (%) | Remark |
| 1 | 1 | 1030 | 41 | 18 | 3 | — | — | Example |
| 2 | 2 | 625 | 23 | 28 | 5 | 110 | 20 | Example |
| 3 | 2 | 620 | 25 | 25 | 6 | 100 | 25 | Example |
| 4 | 3 | 550 | 19 | 30 | 6 | 140 | 30 | Example |
| 5 | 4 | 542 | 12 | 31 | 5 | 130 | 25 | Example |
| 6 | 5 | 712 | 28 | 36 | 3 | — | — | Example |
| 7 | 1 | 1015 | 70 | 13 | 5 | — | — | Comparative example |
| 8 | 2 | 580 | 50 | 20 | 6 | 80 | 30 | Comparative example |
| 9 | 3 | 575 | 27 | 28 | 9 | 85 | 31 | Comparative example |
| 10 | 4 | 545 | 25 | 26 | 7 | 85 | 38 | Comparative example |
| 11 | 5 | 710 | 29 | 29 | 6 | — | — | Comparative example |

TABLE 4

| Steel sheet No. | Steel No. | Slab heat-treatment history | Finish temperature (° C.) | Difference in finish temperature (° C.) | Time to start the primary cooling (sec) | Primary cooling speed (° C./sec) | Variations in end temperature of the primary cooling (° C.) | Time of air-cooling (sec) | Secondary cooling speed (° C./sec) | Coiling temperature (° C.) | Remark |
|---|---|---|---|---|---|---|---|---|---|---|---|
| 12 | 1 | Casting, then heating to 1,250° C. | (Arcm + 20)~(Arcm + 50) | 30 | 1.3 | 430 | 640~662 | 6 | 20 | 600 | E |
| 13 | 2 | Casting, then hot direct rolling | (Ar3 + 25)~(Ar3 + 45) | 20 | 0.6 | 450 | 680~720 | 7 | 200 | 600 | E |
| 14 | 2 | Casting, then hot direct rolling | (Ar3 + 15)~(Ar3 + 45) | 30 | 1.3 | 430 | 675~704 | 7 | 20 | 570 | E |
| 15 | 3 | Casting, then heating to 1,200° C. | (Ar3 + 30)~(Ar3 + 40) | 10 | 0.6 | 430 | 663~690 | 6 | 15 | 30 | E |
| 16 | 4 | Casting, then heating to 1,200° C. | (Ar3 + 5)~(Ar3 + 35) | 30 | 0.3 | 420 | 674~712 | 10 | 30 | 450 | E |
| 17 | 5 | Casting, then heating to 1,200° C. | Ar3~(Ar3 + 20) | 20 | 0.6 | 455 | 670~695 | 8 | 25 | 400 | E |
| 18 | 1 | Casting, then heating to 1,250° C. | (Arcm − 10)~(Arcm + 55) | 65 | 1.1 | 60 | 630~691 | 7 | 10 | 610 | C |
| 19 | 2 | Casting, then heating to 1,250° C. | (Ar3 + 20)~(Ar3 + 40) | 20 | 0.7 | 55 | 665~734 | 8 | 25 | 610 | C |
| 20 | 3 | Casting, then heating to 1,200° C. | (Ar3 + 25)~(Ar3 + 50) | 25 | 0.5 | 50 | 649~713 | 6 | 25 | 30 | C |
| 21 | 4 | Casting, then heating to 1,200° C. | Ar3~(Ar3 + 25) | 25 | 0.4 | 60 | 661~724 | 6 | 60 | 450 | C |
| 22 | 5 | Casting, then heating to 1,200° C. | Ar3~(Ar3 + 15) | 15 | 0.4 | 60 | 670~725 | 10 | 50 | 400 | C |

E: Example
C: Comparative example

TABLE 5

| Steel | | Mechanical properties of hot-rolled coil | | | | |
|---|---|---|---|---|---|---|
| sheet No. | Steel No. | TS(MPa) | Δ TS(MPa) | EI(%) | Δ EI(%) | Remark |
| 12 | 1 | 1020 | 31 | 19 | 2 | Example |
| 13 | 2 | 620 | 18 | 28 | 3 | Example |
| 14 | 2 | 616 | 16 | 26 | 4 | Example |
| 15 | 3 | 560 | 16 | 31 | 4 | Example |
| 16 | 4 | 541 | 10 | 32 | 4 | Example |
| 17 | 5 | 700 | 20 | 36 | 2 | Example |
| 18 | 1 | 1015 | 105 | 12 | 6 | Comparative example |
| 19 | 2 | 585 | 80 | 20 | 7 | Comparative example |
| 20 | 3 | 580 | 53 | 29 | 9 | Comparative example |
| 21 | 4 | 550 | 50 | 27 | 8 | Comparative example |
| 22 | 5 | 705 | 64 | 29 | 7 | Comparative example |

Embodiment 2

To investigate on refining structure on the basis of primary cooling speeds of higher than 200° C./sec, the inventors of the present invention developed a proximity rapid cooling unit, and conducted detail studies varying the rolling conditions. The inventors found that, under the condition of primary cooling speeds of higher than 200° C./sec, a fine structure exceeding the above-described conventional technology level can be attained even when the reduction in thickness at the final stand of the finish-rolling mill is less than 30% if only the finish-rolling is completed at temperatures of from $Ar_3$ transformation point to ($Ar_3$ transformation point +60° C.) and the period of from the completion of the finish-rolling to the start of cooling is within 1.0 second. Thus, the inventors completed the present invention.

There are several studies on the time to start cooling. For example, JP-A-10-195588 discloses the technology in which the hot-rolling is completed at $Ar_3$ transformation point or above, and the cooling starts within a period of from 0.1 to 5.0 seconds after the completion of the hot-rolling, giving the primary cooling speeds of 50° C./sec or more. The technology, however, does not specify the end temperature of the finish-rolling, and the technology investigates only in the region of 200° C./sec or lower primary cooling speed. Therefore, the effect of the technology of limiting the temperature to start cooling stays at enhancement of ferrite transformation owing to the prevention of formation of coarse austenitic grains before the transformation, as described in the patent publication, not the effect of establishing fine structure.

To the contrary, the present invention realizes fine structure by limiting the range of end temperature of finish-rolling and by regulating the time to start cooling after the rolling, based on the primary cooling speeds of higher than 200° C./sec.

That is, the present invention provides the following-given (1) through (4).

(1) A method for manufacturing high strength hot-rolled steel sheet giving excellent sheet shape and workability, which method comprises the steps of continuously casting a steel consisting essentially of 0.04 to 0.2% C, 0.25 to 2.0% Si, 0.5 to 2.5% Mn, and 0.1% or less Al, by weight, and applying hot-rolling to the obtained slab directly or after reheating thereof. The finish-rolling after the rough-rolling is carried out with the reductions in thickness at the final stand of less than 30%, and the finish-rolling is completed at temperature range of from $Ar_3$ transformation point to ($Ar_3$ transformation point +60° C.). The cooling of the hot-rolled steel sheet starts the primacy cooling within 1.0 seconds after the completion of hot-rolling, and the primary cooling is conducted at cooling speeds of higher than 200° C./sec down to the temperatures of from ($Ar_3$ transformation point −30° C.) to $Ar_1$ transformation point. Slow cooling or air-cooling of the primary-cooled steel sheet is given in a temperature range of from $Ar_3$ transformation point to $Ar_1$ transformation point at cooling speeds of 10° C./sec or less for 2 seconds or more. Secondary cooling is applied to the steel sheet after the slow cooling or the allowed to stand for cooling at cooling speeds of 30° C./sec or more. Then coiling is applied to the secondary-cooled steel sheet at temperatures of 300° C. or below.

(2) The method for manufacturing high strength hot-rolled steel sheet of above-described (1) giving excellent sheet shape and workability further comprises the step of heating the sheet bar at inlet side of the continuous hot finish-rolling mill or between stands of the continuous hot finish-rolling mill.

(3) The method for manufacturing high strength hot-rolled steel sheet of above-described (1) or (2) giving excellent sheet shape and workability, wherein the steel further contains 0.01 to 0.2%, by weight, at least one element selected from the group consisting of Ti, Nb, V, and Zr.

(4) The method for manufacturing high strength hot-rolled steel sheet of either one of above-described (1) through (3) giving excellent sheet shape and workability, wherein the steel further contains at least one of 1% or less Cr and 0.5% or less Mo.

The present invention is further described in detail in the following.

The hot-rolled steel sheets according to the present invention are used for automobile parts, members for mechanical structures, and the like, and are high strength hot-rolled steel sheets that have 490 to 980 MPa class tensile strength and have excellent sheet shape and workability, or their steel sheets. In the high strength steel sheets according to the present invention, to attain superior workability level from either of manufacturing processes of hot direct rolling process in which the continuous casting through the hot-rolling are directly conducted or of manufacturing process accompanied with reheating, it is necessary to control the specified contents of C, Si, Mn, sol.Al, and other specified added elements in the steel, and furthermore, it is necessary to control the hot-rolling conditions (end temperature of finish-rolling, time to start the runout table cooling after completed the finish-rolling, runout table cooling speed, and coiling temperature).

The following is the description on the chemical composition and microstructure of the steel and on the manufacturing conditions for the steel according to the present invention.

(1) Steel Microstructure

The steel composition according to the present invention is essentially of: 0.04 to 0.2% C, 0.25 to 2.0% Si, 0.5 to 2.5% Mn, and 0.1% or less sol.Al, by weight, and, at need, 0.01 to 0.2% the sum of at least one element selected from the group consisting of Ti, Nb, V, and Zr, and, furthermore at need, one or both of 1% or less Cr and 0.5% or less Mo.

C: 0.04 to 0.2%

Carbon improves the hardenability of non-transformed austenite, and allows the presence of adequate amount of martensite or of an adequate amount of mixture of martensite and bainite in the texture. If, however, the C content is less than 0.04%, the above-given effect cannot be attained. And, if the C content exceeds 0.2%, the workability and the weldability degrade. Accordingly, the C content is specified to a range of from 0.04 to 0.2%.

Si: 0.25 to 2.0%

Silicon is an element that strengthens ferrite by strengthening solid solution, that enhances the precipitation of ferrite during slow cooling or air-cooling after the hot-rolling in a temperature range of from $Ar_3$ transformation point to the $Ar_1$ transformation point, thus to precipitate the ferrite within a short time, and that contributes to the C enriching to the non-transformed austenite. However, if the Si content is less than 0.25%, the above-given effect cannot be attained. And, if the Si content exceeds 2.0%, the weldability and the surface properties degrades. Consequently, the Si content is specified to a range of from 0.25 to 2.0%.

Mn: 0.5 to 2.5%

Manganese is an element to enhance the hardenability of non-transformed austenite, and has the same effect as that of above-described C. If, however, the Mn content is less than 0.5%, the above-given effect cannot be attained. And, if the Mn content exceeds 2.5%, the above-given effect saturates, and a banded structure is formed to degrade the workability of the steel sheet. Therefore, the Mn content is specified to a range of from 0.5 to 2.5%.

Sol. Al: 0.1% or Less

Aluminum is used as a deoxidizer and has an effect to enhance the workability by fixing N which exists as an inevitable impurity. If, however, the content of sol.Al exceeds 0.1%, the effect saturates, and the cleanliness is degraded to degrade the workability. Thus, the content of sol.Al is specified to 0.1% or less.

Ti, Nb, V, Zr: 0.01 to 0.2% as the Sum of One or More of Them

Titanium, Nb, V, and Zr may be added at one or more of them to a range of from 0.01 to 0.2% as sum of them, at need, either to attain the strength adjustment or to attain the non-aging property (improved deep drawing performance) through the solid solution C and N by forming carbonitrides. By utilizing the addition of these elements and by adopting the manufacturing method described later, further improved strength and workability of the steel sheet can be attained.

One or Both of 1% or Less Cr and 0.5% or Less Cr

Chromium and Mo are the elements to enhance the hardenability of non-transformed austenite, and have similar effect with that of C and Mn. They are, however, expensive elements, and excessive addition increases the cost, and degrades the weldability. The cost increase and the degradation in weldability occur in the case that Cr content exceeds 1% and that Mn content exceeds 0.5%. Accordingly, the Cr content is specified to 1% or less, and the Mn content is specified to 0.5% or less.

According to the present invention, adding to the above-given components, Ca may be added to 0.005% or less, for example, to improve the workability. Other elements, for example, trace amount elements may further be added to improve the hot-workability, as far as the effect of the present invention is not affected.

(2) Manufacturing Conditions

According to the present invention, a steel having the above-described composition is continuously cast to form a slab, and the slab is hot-rolled directly or after reheated. After the rough-rolling, finish-rolling is given to the slab at reductions in thickness of less than 30% at the final stand, and the finish-rolling is completed at temperatures of from $Ar_3$ transformation point to ($Ar_3$ transformation point +60° C.). Then, the cooling starts within 1.0 second after completed the finish-rolling at primary cooling speeds of more than 200° C./sec through a cooling range of from (Ar3 transformation point −30° C.) to $Ar_1$ transformation point. And, slow cooling or air-cooling is applied at cooling speeds of 10° C./sec or less through a cooling range of from $Ar_3$ transformation point to $Ar_1$ transformation point for 2 seconds or more. And the secondary cooling is applied at cooling speeds of 30° C./sec or more. Then coiling is applied at temperatures of 300° C. or below.

The reason to specify the reduction in thickness at the final stand to less than 30% is to adjust the sheet shape. If the reduction in thickness at the final stand is 30% or more, the adjustment of sheet shape becomes difficult, and the steel sheet having superior sheet shape cannot be attained. The lower limit of the reduction in thickness at the final stand is not specifically specified. However, it is preferable that the drafting is carried out at reduction in thickness of 1% or more to assure the shape adjustment.

The finish-rolling is completed in a temperature range of from $Ar_3$ transformation point to ($Ar_3$ transformation point +60° C.), followed by starting the runout table cooling within 1.0 second after the completion of the hot-rolling, then by conducting the primary cooling at cooling speeds of higher than 200° C./sec down to the temperature range of from ($Ar_3$ transformation point −30° C.) to $Ar_1$ transformation point. The reason of the procedure is, aiming at the establishing fine mixed structure of ferrite and austenite which are transformed and generated during succeeding slow cooling or air-cooling through the temperature range of from $Ar_3$ transformation point to $Ar_1$ transformation point, to reduce the austenitic grain size before starting the runout table cooling, to increase the density of the transformed band within the austenitic grains, thus to increase the frequency of generation of ferritic nuclei during the transformation.

By regulating the end temperature of finish-rolling to a range of from $Ar_3$ transformation point to ($Ar_3$ transformation point +60° C.), and by starting the runout table cooling within 1.0 second after the completion of finish-rolling, the size of austenitic grains before transformation can be reduced, and the density of deformed band in the grains can be maintained to a satisfactorily high level, thus allowing to generate large number of ferritic nuclei not only from the austenitic grain boundaries but also from inside of grains. By conducting cooling after starting the runout table cooling at primary cooling speeds of higher than 200° C./sec, the temperature to start the generation of ferritic nuclei can be suppressed to a low level, and the mixed structure of ferrite and austenite generated by transformation during slow cooling or air-cooling in a temperature range of from $Ar_3$ transformation point to $Ar_1$ transformation point. In that case, higher primary cooling speed is more preferable, and a preferred primary cooling speed is 300° C./sec or more.

Following to the above-described primary cooling at cooling speeds of higher than 200° C./sec, slow cooling or air-cooling is given in a temperature range of from $Ar_3$ transformation point to $Ar_1$ transformation point at cooling speeds of 10° C./sec or less for 2 seconds or more, and the secondary cooling at cooling speeds of 30° C./sec or more, then coiling is applied at temperatures of 300° C. or below. The reason of the procedure is to let a part of austenite transform to ferrite by slow cooling or air-cooling, and to make the non-transformed austenite to martensite or to a mixture of martensite with a part bainite through the succeeding secondary cooling, thus to provide a hot-rolled steel sheet having texture consisting mainly of ferrite and martensite.

The slow cooling or the air-cooling is given in a temperature range of from $Ar_3$ transformation point to $Ar_1$ transformation point at cooling speeds of 10° C./sec or less. The reason of the procedure is that the ferrite transformation is enhanced and that the sufficient development of the ferrite transformation needs slow cooling or air-cooling for 2 seconds or more. If, however, the slow cooling or the air-cooling exceeds 20 seconds, pearlite is likely generated. And, the generation of pearlite degrades the workability. Accordingly, the time for slow cooling or for allowing to start cooling is preferably 20 seconds or less.

Then, the coiling is applied at temperatures of 300° C. or below after the secondary cooling at cooling speeds of 30° C./sec or more. The reason of the procedure is that non-transformed austenite is transformed to prepare martensite structure or a mixed structure of martensite with part bainite. The cooling speed of less than 30° C./sec cannot stably give martensite. The coiling temperature of higher than 300° C. cannot give low yield ratio, which is a feature of the textured steel, owing to the mildness of martensite by tempering in the course of cooling of coiled steel and owing to the recovery of movable dislocation which was introduced in the interface of ferrite and martensite.

Under the above-described manufacturing conditions, a high strength hot-rolled steel sheet having excellent sheet shape and workability is obtained by improving the balance of elongation and strength through establishing the fine texture of the steel sheet consisting mainly of ferrite and martensite without degrading the sheet shape.

The inventors of the present invention carried out experiments to identify the influence of the above-described primary cooling speed and the time to start cooling on the balance of elongation and strength of the steel sheet. According to the experiments, each of slabs prepared by continuously casting a steel of 0.08C-0.51Si-1.20 Mn-0.04sol.Al was subjected to rough-rolling, and each of the obtained sheet bars was treated by finish-rolling at a reduction in thickness of 25% at the final stand and at an end temperature of ($Ar_3$ transformation point +25° C.), then each of the sheet bars was cooled down to the temperature of ($Ar_3$ transformation point −60° C.) starting the cooling at respective time of from 0.1 to 1.6 seconds under the respective cooling speeds of 150, 300, and 450° C./sec, and each of the primary-cooled steel sheets was allowed to stand for cooling for 7 seconds, then each of the steel sheets was coiled at 150° C. to prepare the respective steel sheets. The obtained steel sheets were tested by a tensile tester to determine the values of TS×El. FIG. 1 is a graph showing the influence of the time to start cooling and the primary cooling speed on the TS×El value of steel sheet. From FIG. 1, it was confirmed that the condition of higher than 200° C./sec of the primary cooling speed and of within 1 second of the time to start cooling provide steel sheets having high TS×El value and superior balance of elongation and strength.

In addition, if the temperature is adjusted by heating the sheet bar at inlet side of the continuous hot finish-rolling mill or between stands of the continuous hot finish-rolling mill to control the end temperature of hot-rolling to a narrow temperature range on the $Ar_3$ transformation point, the effect to establish fine microstructure of steel sheet according to the present invention can be more effectively attained. That type of sheet bar heating may be carried out by an induction heating unit installed at the inlet side of continuous hot finish-rolling mill or between stands of continuous hot finish-rolling mill.

Furthermore, when steel sheets having thicknesses of 2.0 mm or less are manufactured, the effect of the present invention can be attained also by heating the sheet bar at edge portion in the width direction thereof using an induction heating unit installed at the inlet side of continuous hot finish-rolling mill or between stands of continuous hot finish-rolling mill.

Since the effect of the present invention is attained, in principle, independent of the application or not-application of heating or soaking of sheet bar before the finish-rolling, the manufacturing method according to the present invention is applicable, not limited to the above-described process that uses the induction heating of sheet bar, but also to a continuous hot-rolling process that uses a coil box and the like for soaking the sheet bar followed by welding.

EXAMPLES

The examples according to the present invention are described below.

Steels having compositions of Steel Nos. 1 through 5 in Table 6 were prepared by melting, which were then continuously cast to manufacture respective slabs. Hot-rolled steel samples Nos. 1 through 10 were prepared by cutting from the slabs under the condition given in Table 7, each having a thickness of 2.6 mm. Tensile test was given to each of the samples to determine the mechanical properties. Table 7 shows the result and the value of TS×El as an index of balance of elongation and strength of the steel sheet.

The hot-rolled steel sheet samples Nos. 1, 3, 5, 7, and 9 which satisfy both the chemical composition and the manufacturing condition according to the present invention give high balance of elongation and strength, (TS×El), low yield ratio, (YR), high strength and superior workability, and excellent sheet shape. To the contrary, the samples Nos. 2, 4, 6, and 8 which have the same composition with that of Nos. 1, 3, 5, 7, and 9, while failing to satisfy the manufacturing condition of the present invention give inferior balance of elongation and strength, (TS×El), and yield ratio, (YR). The sample No. 10 failed to attain excellent sheet shape owing to high final reduction in thickness of finish-rolling, though the workability is excellent.

TABLE 6

| Steel | Steel composition (wt %) | | | | | | | |
|---|---|---|---|---|---|---|---|---|
| No. | C | Si | Mn | P | S | sol.Al | N | Other |
| 1 | 0.06 | 0.65 | 1.05 | 0.011 | 0.005 | 0.054 | 0.0030 | |
| 2 | 0.08 | 0.40 | 1.25 | 0.012 | 0.004 | 0.048 | 0.0027 | |
| 3 | 0.13 | 0.83 | 1.15 | 0.009 | 0.006 | 0.045 | 0.0022 | Ti: 0.02 Cr: 0.35 |
| 4 | 0.15 | 1.06 | 0.98 | 0.012 | 0.003 | 0.058 | 0.0031 | Mo: 0.25 |
| 5 | 0.18 | 1.35 | 1.83 | 0.012 | 0.005 | 0.048 | 0.0031 | |

TABLE 7(a)

| | | Manufacturing conditions | | | | | | | | | |
|---|---|---|---|---|---|---|---|---|---|---|---|
| Sample No. | Steel No. | Slab heat treatment history | Finish final reduction in thickness (%) | Temperature of finish-rolling (° C.) | Time to start cooling (sec) | Primary cooling speed (° C./sec) | End temperature of the primary cooling (° C.) | Time of slow cooling or time of air-cooling (sec) | Secondary cooling speed (° C./sec) | Coiling temperature (° C.) | Classification |
| 1 | 1 | Hot direct rolling | 5 | $Ar_3$ + 30 | 0.35 | 400 | $Ar_3$ − 50 | 5 | 50 | 250 | E |
| 2 | 1 | Hot direct rolling | 10 | $Ar_3$ + 35 | 1.30 | 450 | $Ar_3$ − 50 | 7 | 45 | 250 | C |
| 3 | 2 | Heating to 1,200° C. | 10 | $Ar_3$ + 30 | 0.25 | 480 | $Ar_3$ − 50 | 7 | 55 | 200 | E |
| 4 | 2 | Heating to 1,200° C. | 10 | $Ar_3$ + 90 | 0.55 | 370 | $Ar_3$ − 60 | 7 | 45 | 250 | C |
| 5 | 3 | Heating to 1,250° C. | 10 | $Ar_3$ + 20 | 0.40 | 310 | $Ar_3$ − 65 | 7 | 50 | 200 | E |
| 6 | 3 | Heating to 1,250° C. | 7 | $Ar_3$ + 25 | 0.20 | 180 | $Ar_3$ − 50 | 10 | 80 | 250 | C |
| 7 | 4 | Heating to 1,200° C. | 7 | $Ar_3$ + 25 | 0.35 | 350 | $Ar_3$ − 60 | 5 | 80 | 200 | E |
| 8 | 4 | Heating to 1,200° C. | 7 | $Ar_3$ + 40 | 0.45 | 300 | $Ar_3$ − 15 | 10 | 80 | 200 | C |
| 9 | 5 | Heating to 1,200° C. | 20 | $Ar_3$ + 40 | 0.65 | 450 | $Ar_3$ − 40 | 10 | 45 | 250 | E |
| 10 | 5 | Heating to 1,200° C. | 40 | $Ar_3$ + 30 | 0.35 | 410 | $Ar_3$ −40 | 5 | 55 | 350 | C |

E: Example
C: Comparative example

TABLE 7(b)

| | | Tension test value | | | | | | |
|---|---|---|---|---|---|---|---|---|
| Sample No. | Steel No. | YP (MPa) | TS (MPa) | EI (%) | TS × EI (MPa · %) | YR | Shape | Classification |
| 1 | 1 | 379 | 618 | 36 | 22248 | 0.61 | Good | Example |
| 2 | 1 | 432 | 603 | 30 | 18090 | 0.72 | Good | Comparative example |
| 3 | 2 | 402 | 621 | 35 | 21735 | 0.65 | Good | Example |

TABLE 7(b)-continued

| Sample No. | Steel No. | Tension test value YP (MPa) | TS (MPa) | EI (%) | TS × EI (MPa · %) | YR | Shape | Classification |
|---|---|---|---|---|---|---|---|---|
| 4 | 2 | 443 | 591 | 29 | 17139 | 0.75 | Good | Comparative example |
| 5 | 3 | 512 | 825 | 27 | 22275 | 0.62 | Good | Example |
| 6 | 3 | 585 | 795 | 23 | 18285 | 0.74 | Good | Comparative example |
| 7 | 4 | 498 | 835 | 27 | 22545 | 0.60 | Good | Example |
| 8 | 4 | 611 | 790 | 22 | 17380 | 0.77 | Good | Comparative example |
| 9 | 5 | 652 | 989 | 21 | 20769 | 0.66 | Good | Example |
| 10 | 5 | 647 | 983 | 21 | 20643 | 0.66 | Significant edge wave | Comparative example |

Embodiment 3

The inventors of the present invention carried out extensive study on the influence of cooling after the finish-rolling on the fineness of texture concentrating on the manufacture of textured steel prepared by two stage cooling process. The study revealed that, in the two stage cooling at the runout table cooling after the finish-rolling, effectiveness is attained by selecting the time until starting the primary cooling within 1.0 second and by applying high speed cooling of higher than 200° C./sec of the primary cooling speed.

The present invention was completed on the basis of the finding. That is, the present invention provides:

1. A method for manufacturing highly workable hot-rolled steel sheet comprising the steps of: (a) rough-rolling after continuous casting a steel consisting essentially of 0.04 to 0.2% C, 0.25 to 2.0% Si, 0.5 to 2.5% Mn, and 0.1% or less sol.Al, by weight; (b) finish-rolling the sheet bar including cumulative reductions in thickness of 30% or more at temperatures of 1,050° C. or below, and at rolling end temperatures of from $Ar_3$ transformation point to ($Ar_3$ transformation point +60° C.); (c) primary-cooling the finish-rolled steel sheet within 1.0 second after completed the finish-rolling at cooling speeds of higher than 200° C./sec through a cooling range where the difference between the temperature to start cooling and the end temperature of the cooling is in a range of from 100° C. to less than 250° C.; (d) cooling the primary-cooled steel at cooling speeds of 10° C./sec or less for a period of from 2 seconds to less than 20 seconds in a temperature range of from above 580° C. to 720° C., followed by secondary-cooling at cooling speeds of 30° C./sec or more; and (e) coiling the secondary cooled steel sheet at temperatures of below 400° C.

2. The method for manufacturing highly workable hot-rolled steel sheet of above-described 1 further comprising the step of heating the sheet bar using a heating unit installed at inlet side of the continuous hot finish-rolling mill or between stands of the continuous hot finish-rolling mill.

3. The method for manufacturing highly workable hot-rolled steel sheet of above-described 1 or 2, wherein the steel further contains 0.01 to 0.2%, by weight, at least one element selected from the group consisting of Ti, Nb, V, and Zr.

4. The method for manufacturing highly workable hot-rolled steel sheet of above-described 1, 2, or 3, wherein the steel further contains at least one of 1% or less Cr and 0.5% or less Mo.

The detail description of the specification of the composition and the manufacturing conditions is given below.

1. Composition

C

Carbon is added to 0.04% or more to improve the hardenability of austenite and to secure the strength by containing adequate amount of martensite or a mixture of martensite with bainite in the texture. If the C content exceeds 0.2%, the workability and the weldability degrade. Accordingly, the C content is specified to a range of from 0.04 to 0.2%.

Si

Silicon is added to 0.25% or more to strengthen ferrite through the strengthening of solid solution, and to enhance the precipitation of ferrite during slow cooling or air-cooling after hot-rolling to enhance the C enrichment to austenite. If the Si content exceeds 2.0%, the weldability and the surface properties degrade. Consequently, the Si content is specified to a range of from 0.25 to 2.0%.

Mn

Manganese is added to 0.5% or more, similar with C, to improve the hardenability of non-transformed austenite. If the Mn content exceeds 2.5%, the effect saturates and a banded structure is formed to degrade the workability. Therefore, the Mn content is specified to a range of from 0.5 to 2.5%.

sol.Al

Aluminum is added to fix N existing as a deoxidizer and an inevitable impurity thus to improve the workability. If the sol.Al content exceeds 0.1%, the effect saturates, and the cleanliness degrades to degrade the workability. Accordingly, the sol.Al content is specified to 0.1% or less.

The steel according to the present invention contains the above-described elements as the basic composition. Other elements may further be contained in the steel as far as the effect of the present invention is attained. For example, one or more of Ti, Nb, V, Zr, Cr, Mo, and Ca may be added responding to the wanted characteristics such as strength and workability.

Ti, Nb, V, Zr

One or more of Ti, Nb, V, and Zr are added to 0.01 to 0.2% as the sum of them for reducing the solid solution C and N to establish non-aging state by either the strength adjustment or the formation of carbo-nitride, thus for improving the deep drawing performance.

Cr, Mo

Chromium and Mo are added, at need, because they improve the hardenability of austenite and have similar effect with that of C and Mn. Since these elements are expensive, excessive addition thereof increases the base material cost and degrades the weldability. Thus, the Cr content is specified to 1% or less and the Mo content is specified to 0.5% or less.

Ca

Calcium is added to not more than 0.005% for the case to improve the workability.

2. Manufacturing Conditions

The steel according to the present invention is prepared by manufacturing an ingot by continuous casting, which ingot is then subjected to rough-rolling and finish-rolling, followed by two stage cooling including slow cooling. The condition of the rough-rolling is not specifically limited, and the rough-rolling may be done before the finish-rolling, after the reheating, or directly after the continuous casting.

Condition of Finish-Rolling

The finish-rolling is carried out at cumulative reductions in thickness of 30% or more at temperatures of 1,050° C. or below to enhance the formation of ferritic nuclei by introducing strain in the course of cooling stage after the finish-rolling, thus to establish fine structure. The end temperature of rolling is selected to a range of from $Ar_3$ transformation point to ($Ar_3$ transformation point +60° C.) to refine the austenitic grains. For further fining the structure, it is preferable that the rolling temperature is precisely controlled by an induction heating unit installed either at inlet of the continuous hot finish-rolling mill or between stands thereof to bring the end temperature of finish-rolling to directly above the $Ar_3$ transformation point.

Condition of Cooling

Primary Cooling

The primary cooling starts within 1.0 second after completed the rolling to maintain the density of deformed band within the introduced austenitic grains and to generate many ferritic nuclei not only from the austenitic grain boundaries but also from inside of the grains. The cooling speed is higher than 200° C./sec to reduce the temperature to start the ferrite transformation and to reduce the speed of grain growth after the formation of ferritic nuclei. Higher cooling speed is more effective, and 300° C./sec or more is preferred.

The cooling range of the primary cooling is selected so that the difference between the temperature to start the cooling and the end temperature of cooling to become the temperature range of from 100° C. and below 250° C. for reducing the grain size and for assuring the strength.

When the temperature difference is less than 100° C., the precipitation of fine ferrite becomes less, and the grains cannot fully be refined. When the temperature difference is 250° C. or above, bainite is generated before the secondary cooling, which fails to attain satisfactory strength.

After the primary cooling, slow cooling and secondary cooling are applied. The slow cooling is conducted in a temperature range of from above 580° C. to 720° C. at cooling speeds of 10° C./sec or less for 2 seconds or longer period to fully enhance the ferrite transformation. If the cooling time exceeds 20 seconds, pearlite likely precipitates and the workability degrades. So the cooling time is specified to 20 seconds or less. The slow cooling includes air-cooling.

Secondary Cooling

The cooling speed of the secondary cooling is 30° C./sec or more to stably convert austenite to a structure of martensite or of martensite with part containing bainite.

Coiling Temperature

After completed the secondary cooling, coiling is applied. When the coiling temperature is 400° C. or above, sufficient amount of martensite cannot be formed, and the once formed martensite is tempered and softened in the course of coil cooling after the coiling. In addition, the movable dislocation introduced at the ferrite/martensite interface is recovered, thus losing the low yield ratio which is a feature of the textured iron. Therefore, the coiling temperature is specified to below 400° C.

For manufacturing steel sheets having sheet thickness of 2.0 mm or less according to the present invention, since the narrow finish temperature range control is effective for the structure control not only to the sheets having 2.0 mm or less thickness, it is preferable that the edge portion in width direction of sheet bar is heated using an induction heating unit either between stands of continuous hot finish-rolling mill or before the finish-rolling, and the heating does not give bad influence on the effect of the present invention. Furthermore, the present invention can be applied to a continuous hot-rolling process which uses a coil box and the like to weld a soaked sheet bar.

EXAMPLE

Steel having the chemical composition given in Table 8 was prepared by melting. The manufacturing method given in Table 9 was applied to the steel to form respective hot-rolled coils each having a thickness of 3.2 mm. The Samples Nos. 1 and 2 which are the Examples of the present invention and which satisfy the composition and manufacturing conditions of the present invention show superior workability giving excellent balance of strength and notch elongation (TS×N.El) and giving low yield ratio to the Samples Nos. 3 and 4 which are Comparative Examples.

Figure 2:
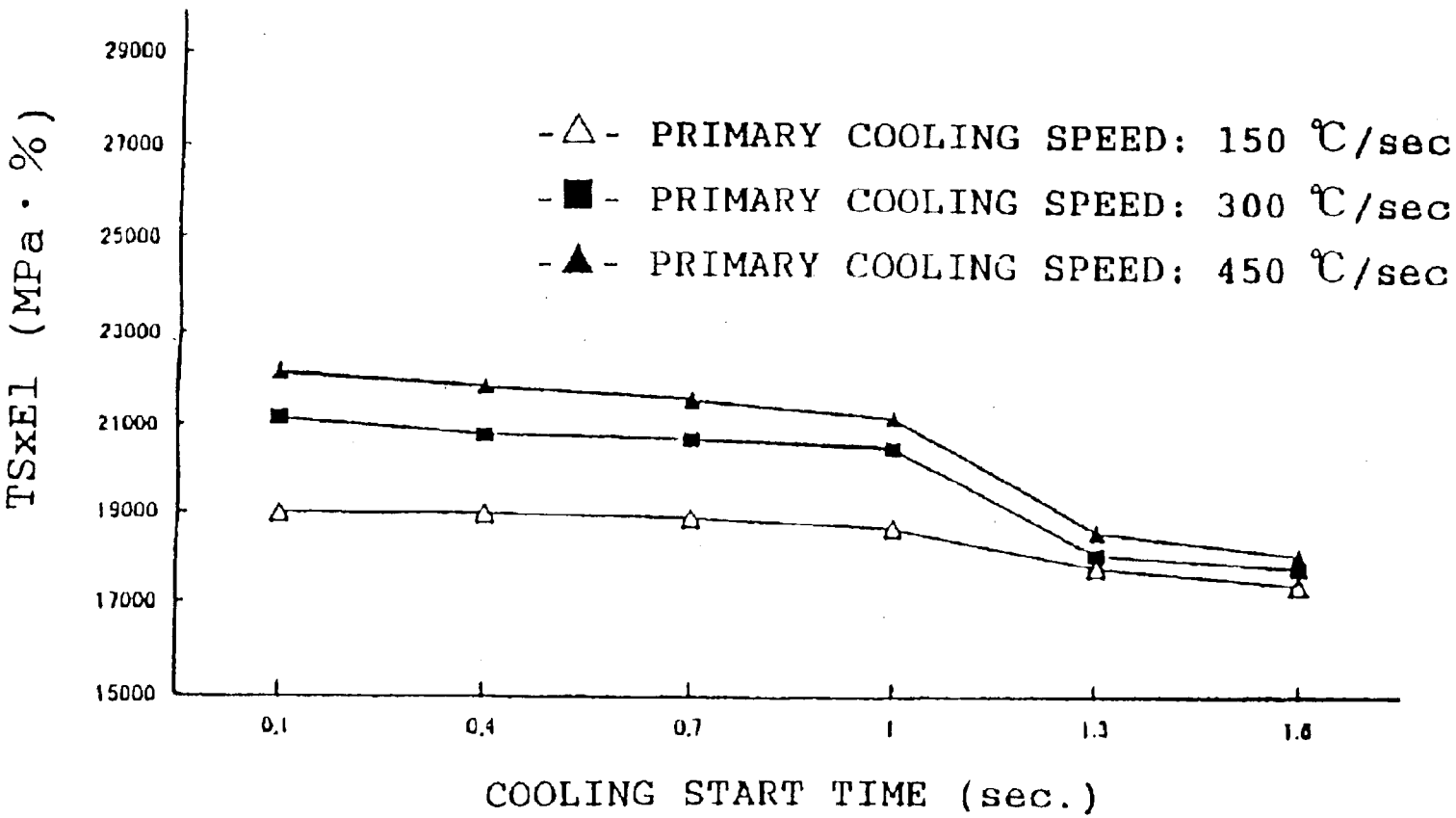
FIG. 2 shows the influence of the primary cooling speed on the balance of notch elongation and strength according to the Embodiment 3.

FIG. 2 shows the influence of the primary cooling speed on the balance of strength and notch elongation (TS×N.El) according to the embodiment.

TABLE 8

| wt % | | | | | | |
|---|---|---|---|---|---|---|
| C | Si | Mn | P | S | sol.Al | N |
| 0.069 | 0.71 | 1.47 | 0.010 | 0.001 | 0.044 | 0.0030 |

TABLE 9

| | | Primary cooling | | | | | | |
|---|---|---|---|---|---|---|---|---|
| Sample No. | Finish temperature (° C.) | Time to start the primary cooling (s) | Primary cooling speed (° C./sec) | Δ T (° C.) | Time of slow cooling (s) | Secondary cooling speed (° C./sec) | Coiling temperature (° C.) | |
| 1 | $Ar_3$ + 20 | 0.5 | 280 | 110 | 6 | 100 | 200 | Example |
| 2 | $Ar_3$ + 30 | 0.5 | 320 | 150 | 6 | 100 | 200 | Example |
| 3 | $Ar_3$ + 30 | 1.0 | 45* | 180 | 8 | 45 | 200 | Comparative example |

TABLE 9-continued

| Sample No. | Finish temperature (° C.) | Primary cooling: Time to start the primary cooling (s) | Primary cooling: Primary cooling speed (° C./sec) | Primary cooling: Δ T (° C.) | Time of slow cooling (s) | Secondary cooling speed (° C./sec) | Coiling temperature (° C.) | |
|---|---|---|---|---|---|---|---|---|
| 4 | $Ar_3$ + 25 | 0 | 3* | 195 | 2 | 100 | 200 | Comparative example |

Note 1: Slow cooling is conducted at the cooling speeds of 10° C./sec or less in the temperature range of from above 580° C. to 720° C. (Slow cooling or air-cooling)
Note 2: Δ T: a cooling range where the difference between the temperature to start cooling and the end temperature of cooling is not less than 100° C. and less than 250° C.
Note 3: The (*) mark indicates the outside of the range of the present invention.

TABLE 10

| Sample No. | YP (MPa) | TS (MPa) | El (%) | N.El (%) | YR (%) | TS × N.El (MPa · %) | |
|---|---|---|---|---|---|---|---|
| 1 | 395 | 706 | 28.4 | 10.2 | 55.9 | 7201 | Example |
| 2 | 371 | 660 | 28.7 | 11.6 | 56.2 | 7656 | Example |
| 3 | 330 | 632 | 28.7 | 9.0 | 52.2 | 5688 | Comparative example |
| 4 | 401 | 631 | 30.4 | 10.0 | 63.5 | 6310 | Comparative example |

Best Mode 4

The inventors of the present invention conducted extensive study on the influence of cooling after the finish-rolling on establishing fine texture. The study revealed that, in the runout table cooling after the finish-rolling, effectiveness is attained by selecting the time until starting the cooling to within 1.0 second and by applying high speed cooling of higher than 200° C./sec of the cooling speed.

The present invention was completed on the basis of the above-described finding with further investigation. That is, the present invention provides:

1. A method for manufacturing highly workable hot-rolled steel sheet comprising the steps of: (a) continuous casting a steel consisting essentially of 0.04 to 0.12% C, 0.25 to 2.0% Si, 0.5 to 2.5% Mn, 0.1% or less Al, by weight, and balance of substantially Fe, followed by rough-rolling thereto; (b) finish-rolling the sheet bar at rolling end temperatures of from $Ar_3$ transformation point or more; (c) cooling the finish-rolled steel sheet within 1.0 second after completed the finish-rolling at cooling speeds of higher than 200° C./sec through a cooling range where the difference between the temperature to start cooling and the end temperature of the cooling is in a range of from 100° C. to less than 250° C.; (d) cooling the cooled steel at cooling speeds of 10° C./sec or less for less than 20 seconds in a temperature range of from 580° C. to 720° C.; and (e) coiling the secondary cooled steel sheet at temperatures of from 400° C. to below 540° C.

2. The method for manufacturing highly workable hot-rolled steel sheet of above-described 1 further comprising the step of heating the sheet bar using a heating unit installed at inlet side of the continuous hot finish-rolling mill or between stands of the continuous hot finish-rolling mill.

3. The method for manufacturing highly workable hot-rolled steel sheet of above-described 1 or 2, wherein the steel further contains 0.01 to 0.2%, by weight, at least one element selected from the group consisting of Ti, Nb, V, and Zr.

4. The method for manufacturing highly workable hot-rolled steel sheet of above-described 1, 2, or 3, wherein the steel further contains at least one of 1% or less Cr and 1.0% or less Mo.

5. The method for manufacturing highly workable hot-rolled steel sheet of above-described any one of 1, 2, 3, and 4, wherein the reduction in thickness at the final stand of the continuous hot finish-rolling mill is less than 30%.

The detail description of the specification of the composition and the manufacturing conditions is given below.

1. Composition

C

Carbon is added to 0.04% or more to improve the hardenability of austenite and to generate adequate amount of bainite in the texture. If the C content exceeds 0.12%, the workability and the weldability degrade. Accordingly, the C content is specified to a range of from 0.04 to 0.12%.

Si

Silicon is added to 0.25% or more to strengthen ferrite through the strengthening of solid solution, and to enhance the precipitation of ferrite during slow cooling or air-cooling in a temperature range of from $Ar_3$ transformation point to $Ar_1$ transformation point after hot-rolling to enhance the C enrichment to austenite. If the Si content exceeds 2.0%, the weldability and the surface properties degrade. Consequently, the Si content is specified to a range of from 0.25 to 2.0%.

Mn

Manganese is added to 0.5% or more, similar with C, to improve the hardenability of non-transformed austenite. If the Mn content exceeds 2.5%, the effect saturates and a banded structure is formed to degrade the workability. Therefore, the Mn content is specified to a range of from 0.5 to 2.5%.

sol.Al

Aluminum is added to fix N existing as a deoxidizer and an inevitable impurity thus to improve the workability. If the sol.Al content exceeds 0.1%, the effect saturates, and the cleanliness degrades to degrade the workability. Accordingly, the sol.Al content is specified to 0.1% or less.

The steel according to the present invention contains the above-described elements as the basic composition. One or more of Ti, Nb, V, Zr, Cr, Mo, and Ca may be added responding to the wanted characteristics such as strength and workability.

Ti, Nb, V, Zr

One or more of Ti, Nb, V, and Zr are added to 0.01 to 0.2% as the sum of them for reducing the solid solution C and N to establish non-aging state by either the strength adjustment or the formation of carbo-nitride, thus for improving the deep drawing performance.

Cr, Mo

Chromium and Mo are added, at need, because they improve the hardenability of austenite and have similar effect with that of C and Mn. Since these elements are expensive, excessive addition thereof increases the base material cost and degrades the weldability. Thus, the Cr content is specified to 1% or less and the Mo content is specified to 1.0% or less.

Ca

Calcium is added to not more than 0.005% for the case to improve the workability.

2. Manufacturing Conditions

The steel according to the present invention is prepared by manufacturing an ingot by continuous casting, which ingot is then subjected to rough-rolling and finish-rolling, immediately followed by cooling. The condition of the rough-rolling is not specifically limited, and the rough-rolling may be done after the reheating of ingot, or directly after the continuous casting.

Condition of Finish-Rolling

The finish-rolling is carried out at end temperatures of rolling of the $Ar_3$ transformation point or above. If the end temperature of rolling is below $Ar_3$ transformation point, ferrite is generated during the rolling to form a significant worked structure, which then significantly degrades the elongation. For further fining the structure, it is preferable that the rolling temperature is precisely controlled by an, induction heating unit installed either at inlet of the continuous hot finish-rolling mill or between stands thereof to bring the end temperature of finish-rolling at directly above the $Ar_3$ transformation point. When the shape adjustment is conducted, the reduction in thickness at the final pass during the finish-rolling is set to less than 30%.

Condition of Cooling

The cooling starts within 1.0 second after completed the rolling to maintain the density of deformed band within the austenitic grains introduced by the finish-rolling and to generate many ferritic nuclei not only from the austenitic grain boundaries but also from inside of the grains. If, however, the time to start cooling is not longer than 0.5 second, the structure may become non-homogeneous owing to nonuniform residual rolling strain. So the time to start cooling is preferably longer than 0.5 second. The cooling speed is higher than 200° C./sec to reduce the temperature to start the ferrite transformation and to reduce the speed of grain growth after the formation of ferritic nuclei. Higher cooling speed is more effective, and 300° C./sec or more is preferred.

The cooling range of the primary cooling is selected so as the difference between the temperature to start cooing and the end temperature of cooling to become the temperature range of from 100° C. and below 220° C. for reducing the grain size and for assuring the strength.

When the temperature difference is less than 100° C., the precipitation of fine ferrite becomes less, and the grain size cannot fully be fully reduced. When the temperature difference is 250° C. or above, needle-shaped ferrite is generated during air-cooling after the cooling, which fails to attain satisfactory strength.

After the cooling, slow cooling is applied. The slow cooling is carried out in a temperature range of from above 580° C. to 720° C. for 2 seconds or more at cooling speeds of 10° C./sec or less. If the slow cooling is conducted for 20 seconds or more, pearlite is likely generated to degrade the workability. So the period for slow cooling is specified to 20 seconds or less. The slow cooling includes air-cooling.

Coiling Temperature

The temperature for coiling is in a range of from 400° C. to below 540° C. When the coiling temperature is 540° C. or above, the structure consisting essentially of bainite cannot be stably obtained. When the coiling temperature is below 400° C., the generation of hard phase martensite increases, which degrades the stretch flanging performance.

Although the cooling after the slow cooling and before the coiling is not specifically specified, 1° C./sec or higher cooling speed is preferable to suppress the generation of pearlite.

For manufacturing steel sheets having sheet thickness of 2.0 mm or less according to the present invention, it is preferable that the edge portion in width direction of sheet bar is heated using an induction heating unit installed either between stands of continuous hot finish-rolling mill or before the finish-rolling, and the heating does not give bad influence on the effect of the present invention. Furthermore, the present invention can be applied to a continuous hot-rolling process which uses a coil box and the like to weld a heat-held sheet bar.

EXAMPLE

Figure 3:
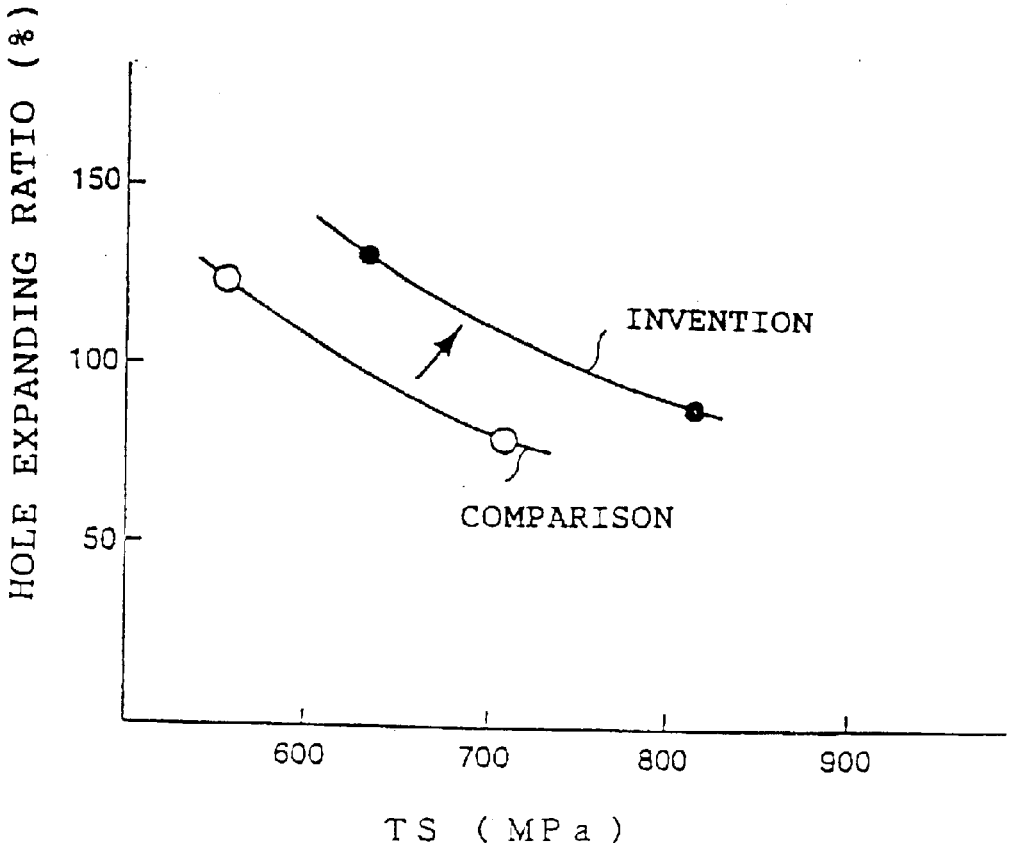
FIG. 3 shows the balance of hole expanding ratio and the strength according to the Embodiment 4.

Steels having the chemical compositions given in Table 11 were prepared by melting. The manufacturing method given in Table 12 was applied to the steels to form respective hot-rolled coils each having a thickness of 3.2 mm. Table 13 shows the mechanical properties of the manufactured hot-rolled steel sheets. The Samples Nos. 1 and 3 which are the Examples of the present invention and satisfy the composition and manufacturing conditions of the present invention show superior workability giving excellent balance of hole expanding ratio and strength (λ×TS) to the Samples Nos. 2 and 4 which are Comparative Examples. Regarding the hole expanding ratio, the steel was descaled, and was punched to open a hole of 10 mm in diameter with a clearance of 12%, then the hole was expanded using a conical punch having 60° apex angle. The hole diameter at the moment that crack penetrated the sheet was measured to determine the hole expanding ratio of the hole diameter as the evaluation index. FIG. 3 shows the balance of hole expanding ratio and strength (λ×TS) obtained in the embodiment.

TABLE 11

| Steel specimen | C | Si | Mn | P | S | sol.Al | Ti |
|---|---|---|---|---|---|---|---|
| 1 | 0.084 | 1.08 | 1.53 | 0.017 | 0.001 | 0.047 | tr. |
| 2 | 0.068 | 0.95 | 1.58 | 0.009 | 0.001 | 0.045 | 0.07 |

TABLE 12

| Sample No. | Steel specimen | Finish temperature (° C.) | Primary Cooling: Time to start the primary cooling (s) | Primary Cooling: Primary cooling speed (° C./sec) | Primary Cooling: Δ T (° C.) | Time of slow cooling (s) | Coiling temperature (° C.) | |
|---|---|---|---|---|---|---|---|---|
| 1 | 1 | 850 | 0.6 | 240 | 115 | 8 | 470 | Example |
| 2 | 1 | 850 | 1.0 | 45 | 190 | 10 | 470 | Example |
| 3 | 2 | 850 | 0.6 | 320 | 180 | 6 | 480 | Comparative example |
| 4 | 2 | 840 | 0 | 6 | 170 | 2 | 500 | Comparative example |

TABLE 13

| Sample No. | YP (MPa) | TS (MPa) | El (%) | λ (%) | TS · λ (MPa · %) | |
|---|---|---|---|---|---|---|
| 1 | 493 | 636 | 34 | 130 | 82680 | Example |
| 2 | 463 | 556 | 33 | 122 | 67832 | Comparative example |
| 3 | 594 | 818 | 24 | 88 | 71984 | Example |
| 4 | 505 | 710 | 24 | 78 | 55380 | Comparative example |

What is claimed is:

1. A method for manufacturing steel sheet comprising the steps of:

continuously casting a steel consisting essentially of 0.04 to 0.2% C, 0.25 to 2% Si, 0.5 to 2.5% Mn, and 0.1% or less Al, by weight, to form a slab; and applying hot-rolling by rough-rolling the slab to form a sheet bar and finish-rolling the sheet bar, the finish-rolling being carried out with the reductions in thickness at the final stand of less than 30%, and the finish-rolling being completed at temperature range of from $Ar_3$ transformation point to ($Ar_3$ transformation point +60° C.);

primary-cooling the hot-rolled steel sheet starting the primary cooling within 1.0 second after the completion of hot-rolling and conducting the cooling at cooling speeds of higher than 200° C./sec down to the temperature range of from ($Ar_3$ −30° C.) to $Ar_1$ transformation point;

applying slow cooling or air-cooling the primary-cooled steel sheet in a temperature range of from Ar3 −30° C. transformation to $Ar_1$ transformation point at cooling speeds of 10° C./sec or less for 2 seconds or more;

secondary-cooling the steel sheet after the slow cooling or the air-cooling at cooling speeds of 30° C./sec or more; and coiling the secondary-cooled steel sheet at temperatures of 300° C. or less.

2. The method for manufacturing steel sheet according to claim 1, further comprising the step of heating the sheet bar at inlet side of the continuous hot finish-rolling mill or between stands of the continuous hot finish-rolling mill.

3. The method for manufacturing steel sheet according to claim 1, wherein the steel further contains 0.01 to 0.2%, by weight, at least one element selected from the group consisting of Ti, Nb, V, and Zr.

4. The method for manufacturing steel sheet according to claim 1, wherein the steel further contains at least one of 1% or less Cr and 0.5% or less Mo.

5. A method for manufacturing steel sheet comprising the steps of:

rough-rolling a steel consisting essentially of 0.04 to 0.2% C, 0.25 to 2% Si, 0.5 to 2.5% Mn, and 0.1% or less Al, by weight to form a a sheet bar;

finish-rolling the sheet bar at rolling temperatures of 1,050° C. or less, cumulative reductions in thickness of 30% or more, and end temperatures of rolling of from $Ar_3$ transformation point to ($Ar_3$ transformation point +60° C.);

primary-cooling the finish-rolled steel sheet within 1.0 second after completed the finish-rolling at cooling speeds of more than 200° C./sec through a cooling range where the difference between the temperature to start cooling and the end temperature of the cooling is in a range of from 100° C. and below 250° C.;

applying slow cooling to the primary-cooled steel sheet at cooling speeds of 10° C./sec or less for a period of from 2 seconds to less than 20 seconds in a temperature range of from above 580° C. to 720° C.;

secondary-cooling the steel sheet after completed the slow cooling at cooling speeds of 30° C./sec or more; and coiling the secondary-cooled steel sheet at temperatures of below 400° C.

6. The method for manufacturing steel sheet according to claim 5, further comprising the step of heating the sheet bar at inlet side of the continuous hot finish-rolling mill or between stands of the continuous hot finish-rolling mill.

7. The method for manufacturing steel sheet according to claim 5, wherein the steel further contains 0.01 to 0.2%, by weight, at least one element selected from the group consisting of Ti, Nb, V, and Zr.

8. The method for manufacturing steel sheet according to claim 5, wherein the steel further contains at least one of 1% or less Cr and 0.5% or less Mo.

* * * * *